United States Patent [19]

Beck

[11] 4,409,746

[45] Oct. 18, 1983

[54] VORTEX INJECTION DREDGING APPARATUS AND METHOD

[75] Inventor: Jeffrey L. Beck, Ponca City, Okla.

[73] Assignee: Conoco Inc., Ponca City, Okla.

[21] Appl. No.: 231,637

[22] Filed: Feb. 5, 1981

[51] Int. Cl.[3] ..... E02F 3/88

[52] U.S. Cl. ..... 37/58; 37/195; 406/96; 406/152; 406/153; 417/54; 417/171

[58] Field of Search ..... 417/54, 65, 171, 194; 406/96, 93, 109, 152, 153; 37/58, 195

[56] References Cited

U.S. PATENT DOCUMENTS 1,856,537 5/1932 Burks ..... 417/78 X 3,708,239 1/1973 Stahle ..... 417/424 X 4,227,863 10/1980 Sommerer ..... 417/169

*Primary Examiner*—Clifford D. Crowder

*Attorney, Agent, or Firm*—William J. Miller

[57] ABSTRACT

A dredging apparatus has a chamber with a substantially circular cross section. A first inlet and outlet is formed through the chamber with an axis of the inlet and outlet normal to a diameter of the chamber. A suction inlet is formed through the axis of the chamber along the axis of the vortex formed as the fluids leave the inlet and pass to a second outlet formed substantially coaxially with the vortex. Apparatus is provided for supporting the dredging apparatus in a position so that the suction inlet can remove material desired to be dredged.

2 Claims, 2 Drawing Figures

VORTEX INJECTION DREDGING APPARATUS AND METHOD

PRIOR ART

The best prior art known to applicant is an application entitled "Vortex Injection Method and Apparatus" filed Dec. 22, 1980, Ser. No. 218,857, by the same inventor as this application and assigned to the same assignee as this application. In the application an injection apparatus has a high pressure inlet and outlet positioned in the same manner as the dredging apparatus of this application. The application differs in that the low pressure inlet is fed by a pump discharging slurry into the low pressure inlet.

BRIEF DESCRIPTION OF THE INVENTION

This invention comprises a vortex injection apparatus which has a sufficiently large low pressure discharge so that a suction is formed at the low pressure inlet whereby material can be sucked into the low pressure inlet or mouth. Means are also provided for supporting the mouth of the low pressure inlet in the vicinity of material to be dredged. Flexible pipes will be coupled to the high pressure inlet and outlet of the injection apparatus. The low pressure outlet will discharge into the environment where the dredging is being performed.

DETAILED DESCRIPTION OF THE INVENTION

Figure 1:
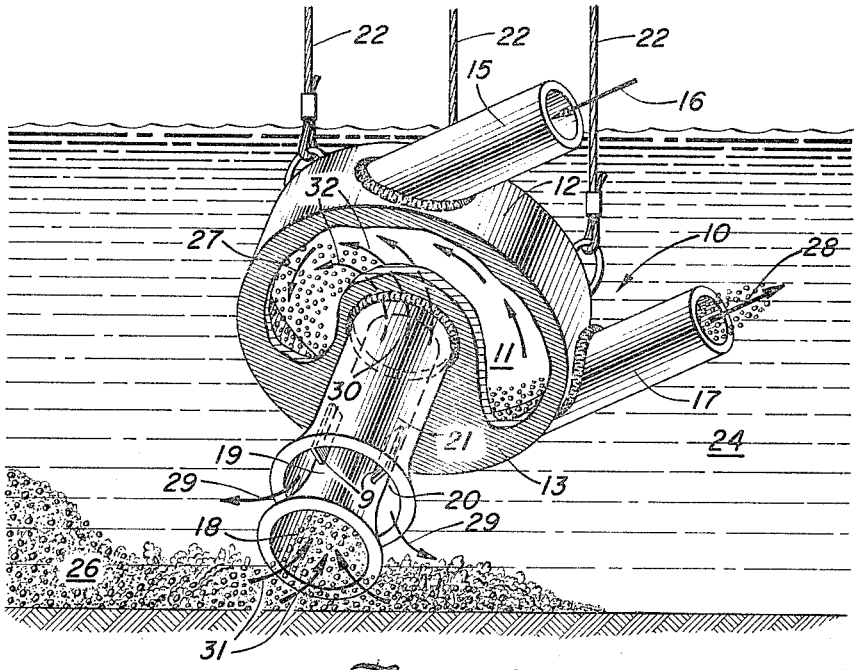
FIG. 1 is a partial cutaway view of the dredging apparatus illustrating the operation of the invention and FIG. 2 illustrates a preferred use for the vortex dredging apparatus.
Figure 2:
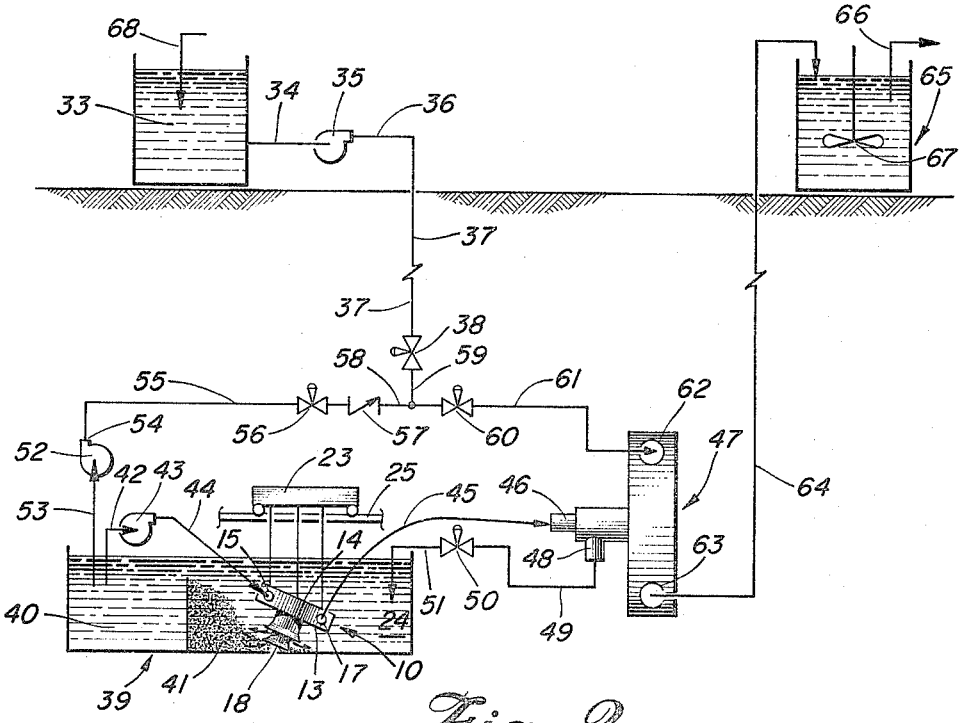

Referring to FIGS. 1 and 2 but in particular to FIG. 1, a vortex dredging apparatus referred to generally by arrow 10 is illustrated. Dredging apparatus includes a chamber 11 which includes a substantially circular sidewall 12 and end 13. The end opposite from 13 is not illustrated in FIG. 1 but is numbered 14 in FIG. 2. A high pressure inlet pipe 15 is attached to sidewall 12 by any usual method such as welding and has its axis normal to a diameter of circular sidewall 12 so that material flowing along in the pipe 15 in the direction of arrow 16 will enter tangentially into chamber 11. A high pressure outlet pipe 17 is, likewise, welded or attached in some manner to sidewall 12 and has its axis normal to a diameter of cylindrical chamber 11. Usually the axis of pipes 15 and 17 will be normal to the same diameter of chamber 11, but the axis of the pipes 15 and 17 does not necessarily need to be normal to the same diameter. A suction mouth 18 is coupled through a pipe 19 to the endwall 13 at its axis. The actual axis for the alignment of pipe 19, however, is the axis of a vortex which will be formed inside chamber 11. The critical location of pipe 19 is, therefore, at the vortex axis and not necessarily the geometric axis of vortex chamber 11. A low pressure outlet 20 is coupled through a pipe 21 to the end 13 of chamber 11 and can be mounted coaxially as illustrated in FIG. 1. Pipe 21 and low pressure outlet 20 can have several configurations. For example, pipe 21 could be a short portion of pipe formed coaxially around pipe 19 with the discharge low pressure outlet 20 exiting normal to the axis of pipe 21. Furthermore, pipe 21 could extend from end 14 preferably along the geometric axis of chamber 11. The vortex dredging chamber can be supported in any of a number of ways, such as, for example, cables 22 which can be attached to cart 23 (see FIG. 2) which is supported above a fluid 24 confined in a sump 39, on tracks 25. Braces 9 support inner pipe 19 coaxially with pipe 21.

Operation

The operation of the apparatus illustrated in FIG. 1 is as follows:

Dredging apparatus 10 is positioned above material 26, for example, which is to be dredged which is suspended or confined in a body of fluid 24. The vortex chamber 10, as previously discussed, can be suspended in any of a number of ways but is illustrated here as being suspended by cables 22. The actual position of the mouth can be adjusted by lengthening or shortening any of the support cables. It is obvious that apparatus 10 can have a rigid support and be coupled to a ship, for example. It can also be coupled to floats or any well known method for supporting a dredging apparatus.

A high pressure fluid enters pipe 15 in the direction of arrow 16 and moves around chamber 10 in the direction of arrow 27. As the fluid moves around chamber 11, a portion of the fluid will exit high pressure outlet 17 in the direction of arrow 28. Also a portion of the fluid will exit down pipe 21 and out low pressure outlet 20 in the direction of arrow 29. The movement of fluid around the vortex chamber 11 and with some passing down low pressure outlet 20 will cause a vortex to form approximately in the center of chamber 11. Since the fluid is passing out pipe 21 in the direction of arrow 29, the vortex will be a low pressure vortex. The pressure will be lower than the pressure at suction mouth 18. With the pressure suction mouth 18 being higher than the pressure at vortex 30, material and fluids will move in the direction of arrows 31 up pipe 19 and into vortex 30. From there the material will move in the direction illustrated by arrows 32, mixing with circulation created by the high pressure fluid moving in the direction of arrow 27 to high pressure outlet 17 as illustrated by arrow 28. Thus the high pressure outlet 17 will carry fluids from high pressure inlet 15 along with fluids and material being suctioned up into mouth 18.

The output of pipe 17 can be coupled through any flexible pipe to a place for storage or disposal. The actual use for the apparatus is illustrated in FIG. 2 which shows the dredging apparatus being utilized in a mine which contains a sump a substantial distance in the mine. Such a sump can be located, for example, as deep as 800 feet below the surface of the earth.

Referring to the apparatus of FIG. 2, a surface water storage system 33 is coupled through a pipe 34 to a pump 35 which is in turn coupled to a pipe 36 which moves the water down a pipe 37 to a control valve 38. A sump 39 has a water storage region 40 and a material storage region 41. Material is dumped in region 41 from any source, such as a mine where the material is transferred from the mine face to the storage region 41. The material can be transferred by rail, by car, or by a slurry system, for example. In order to remove material 41, the vortex dredging device is positioned over the material 41 as illustrated. The water is removed from the water region 40 of sump 39 through pipe 42 by means of a pump 43 which has its outlet connected to a hose 44 which injects high pressure water to the inlet 15 of dredging apparatus 10. The outlet 17 is connected through a flexible pipe 45 to the input 46 of a vortex injection apparatus 47 which is used to lift the removed material to the surface of the mine. The particular apparatus illustrated here is a vortex injection apparatus previously described in application No. 218,857, however, any pumping system can be used. The invention is not so limited as to be limited to a particular type hoisting system. Vortex injection apparatus basically comprises a low pressure outlet 48 which is communicated through a pipe 49 through a control valve 50 and through a pipe 51 to sump 39. The high pressure side of the vortex injection apparatus comprises a pump 52 which is drawing water through a pipe 53 from the water region 40 of sump 39 and delivering it at output 54. High pressure water is communicated through a pipe 55 to a control valve 56, a check valve 57 to pipe 58 which joins with another pipe 59 from control valve 38. Pipe 58 is then connected to control valve 60 to pipe 61 which is coupled to a high pressure inlet 62 of vortex injection apparatus 47. The high pressure output 63 is coupled through pipe 64 which comprises the lifting pipe for removing the material from the mine to the surface of the earth where the material is deposited in a surface sump 65. The material from the surface sump is removed by a second pipe 66 which is connected to a pump and communicated to a preparation plant (not shown). The material may be maintained in a suspension by a stirring apparatus 67. Water separated in the processing plant may be returned through a pipe 68 to water storage system 33.

The operation of the system shown in FIG. 2 is as follows:

Water from preparation plant entering through pipe 68 is stored in water storage system 33 and transferred through pipe 34 and pump 35 to a second pair of pipes 36 and 37 to control valve 38. Valve 38 regulates the amount of water entering the below-mine environment. Water at control valve 38 is directed through pipe 59 and control valve 60, pipe 61 to high pressure inlet 62 of vortex injector 47. The high pressure output 63 now being mixed with slurry in a manner to be described is communicated through pipe 64 to above-ground sump 65. The material is maintained suspended by stirring apparatus 67 until it is removed by pipe 66 and transferred to the prep plant. Dredging device 10 is positioned in sump 39 by tramming cart 23 over tracks 25 to position the mouth 18 over material 41 to be removed, such as coal. Pump 43 sucks water from reservoir 40 through pipe 42 and increases its pressure which is connected through pipe 44 to high pressure inlet 15. Water, along with the coal sucked up into inlet 18 is communicated through pipe 45 to input 46 of vortex injector 47. The vortex injection apparatus creates a vortex similar to the operation described in FIG. 1. The manner in which the vortex is created requires that a low pressure region be developed along the axis of apparatus 47. The low pressure region is created by removal of water at the vortex through low pressure outlet 48. Low pressure outlet 48 will comprise a pipe around the inlet 46 with a second pipe communicated through a pipe 49 through a control valve 50. Pipe 51 empties water back into sump 39. Control valve 50 is used to regulate the water being removed from the low pressure region of the vortex. Since a certain amount of water is removed through pipe 49, water must be made up in order for the device to have sufficient pressure to lift the coal/water slurry through pipe 64. The makeup water is provided by pump 52 drawing water from region 40 and supplying it through pipe 55, control valve 56, check valve 57, control valve 60 through pipe 61 to the high pressure input 62 of vortex injector 47. Control valves 56 and 60 regulate the amount of water being supplied under high pressure. Check valve 57 prevents back flow of water from pipe 59 to pipe 55 through pipe 58.

Conclusions

The particular dredging apparatus illustrated shows the low pressure outlet concentric with inlet pipe 19. It is obvious that the outlet can be placed on the opposite end 14 and still function in the manner described.

It is obvious that changes can be made in the above described apparatus or method of use and still be within the spirit and scope of the invention as disclosed in the specification and appended claims.

What is claimed is:

1. A dredging apparatus for removing solid material from a body of fluid comprising:

(a) a chamber having a substantially circular cross section and an axis normal to said cross section;

(b) first inlet means through said chamber periphery, said inlet means axis normal to a diameter of said circular cross section;

(c) first outlet means through said chamber periphery, said outlet means axis normal to a diameter of said circular cross section;

(d) suction inlet means through said chamber substantially coaxially aligned with said chamber axis;

(e) fluid outlet means through said chamber substantially coaxially aligned with said chamber axis;

(f) support means for positioning said suction inlet in said body of fluid in a manner to move said fluid and said solid material to be dredged, into said suction inlet;

(g) means for communicating a high pressure fluid to said first inlet; and (h) means for communicating fluid mixed with dredged material from said first outlet means, whereby said suction inlet means will pick up solid material and fluid and communicate same through said first outlet and communicating means to a remote location.

2. A method of dredging solid material from a body of fluid comprising:

(a) injecting a high pressure fluid tangentially into a zone having a circular cross section;

(b) removing a portion of said injected fluid along the axis of said zone to form a low pressure vortex in said zone;

(c) positioning an intake to said zone over solid material in said body of fluid to be dredged;

(d) transporting through said intake, fluids and solids with said low pressure vortex whereby said intake fluids and solids form a slurry with said high pressure fluid in said zone; and (e) separately removing said slurry from said zone tangentially through a high pressure outlet.

* * * * *